US005676607A

United States Patent [19]

Stumpf

[11] Patent Number: 5,676,607

[45] Date of Patent: Oct. 14, 1997

[54] LASER BEAM STRIKE ZONE INDICATOR

[76] Inventor: Ernest A. Stumpf, 1222 Paseo Gracia, San Dimas, Calif. 91773

[21] Appl. No.: 747,250

[22] Filed: Nov. 18, 1996

[51] Int. Cl.[6] ..... A63B 71/02

[52] U.S. Cl. ..... 473/455

[58] Field of Search ..... 473/454, 455, 473/456; 273/271

[56] References Cited

U.S. PATENT DOCUMENTS 4,545,576 10/1985 Harris ..... 273/25
4,611,993 9/1986 Brown ..... 273/371 X
4,941,662 7/1990 Deperna ..... 273/25
4,972,172 11/1990 McLaughlin ..... 340/331
5,069,450 12/1991 Pyle ..... 273/25
5,071,122 12/1991 Messina ..... 273/26 R
5,401,016 3/1995 Heglund et al. ..... 473/455 X

*Primary Examiner*—Willliam H. Grieb

[57] ABSTRACT

A laser beam strike zone indicator including a home plate. A plurality of adjustable laser beams are directed upwardly from the home plate to define a strike zone for a height of a predetermined batter.

3 Claims, 2 Drawing Sheets

LASER BEAM STRIKE ZONE INDICATOR

BACKGROUND OF THE INVENTION

1. Field of the Invention

The present invention relates to a laser beam strike zone indicator and more particularly pertains to establishing an electronic strike detection zone for baseball and softball with a laser beam strike zone indicator.

2. Description of the Prior Art

The use of strike indicators is known in the prior art. More specifically, strike indicators heretofore devised and utilized for the purpose of indicating whether a pitched ball is a strike are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,401,016 to Heglund et al. discloses an automatic baseball ball and strike indicator.

U.S. Pat. No. 5,069,450 to Pyle discloses an automatic umpire for slow pitch softball.

U.S. Pat. No. 4,545,576 to Harris discloses a baseball-strike indicator and trajectory analyzer and method of using same.

U.S. Pat. No. 5,071,122 to Messina discloses a baseball batting training apparatus.

U.S. Pat. No. 4,972,172 to McLaughlin discloses a portable, blinking alarm status and theft deterrent indicator.

U.S. Pat. No. 4,941,662 to DePerna discloses a baseball game.

While these devices fulfill their respective, particular objective and requirements, the aforementioned patents do not describe a laser beam strike zone indicator for establishing an electronic strike detection zone for baseball and softball.

In this respect, the laser beam strike zone indicator according to the present invention substantially departs from the conventional concepts and designs of the prior art, and in doing so provides an apparatus primarily developed for the purpose of establishing an electronic strike detection zone for baseball and softball.

Therefore, it can be appreciated that there exists a continuing need for new and improved laser beam strike zone indicator which can be used for establishing an electronic strike detection zone for baseball and softball. In this regard, the present invention substantially fulfills this need.

SUMMARY OF THE INVENTION

In the view of the foregoing disadvantages inherent in the known types of strike indicators now present in the prior art, the present invention provides an improved laser beam strike zone indicator. As such, the general purpose of the present invention, which will be described subsequently in greater detail, is to provide a new and improved laser beam strike zone indicator and method which has all the advantages of the prior art and none of the disadvantages.

To attain this, the present invention essentially comprises a home plate having a front portion and a back portion. The front portion has a square configuration and the back portion has a triangular configuration. A base of the back portion is integral with a rear edge of the front portion. The home plate is further defined by five corner points. The five corner points include two front points, two intermediate points and a single rear point. The device includes a plurality of adjustable laser beams comprised of two front beams, two intermediate beams and two rear beams. The two front beams are disposed within the two front points of the home plate. The two intermediate beams are disposed within the intermediate points of the home plate. The two rear beams are disposed within the single rear point of the home plate. The two front beams are directed upwardly to a height of a batter's armpits in an orthogonal relationship with respect to opposing sides of the home plate. The two intermediate beams are directed angularly upwardly to intersect the two front beams at a height of the batter's knees. The two rear beams are directed angularly upwardly to intersect the two front beams at the height of the batter's armpits.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laser beam strike zone indicator which has all the advantages of the prior art strike indicators and none of the disadvantages.

It is another object of the present invention to provide a new and improved laser beam strike zone indicator which may be easily and efficiently manufactured and marketed.

It is a further object of the present invention to provide a new and improved laser beam strike zone indicator which is of durable and reliable construction.

An even further object of the present invention is to provide a new and improved laser beam strike zone indicator which is susceptible of a low cost of manufacture with regard to both materials and labor, and which accordingly is then susceptible of low prices of sale to the consuming public, thereby making such a laser beam strike zone indicator economically available to the buying public.

Even still another object of the present invention is to provide a new and improved laser beam strike zone indicator for establishing an electronic strike detection zone for baseball and softball.

Lastly, it is an object of the present invention to provide a new and improved laser beam strike zone indicator including a home plate. A plurality of adjustable laser beams are directed upwardly from the home plate to define a strike zone for a height of a predetermined batter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
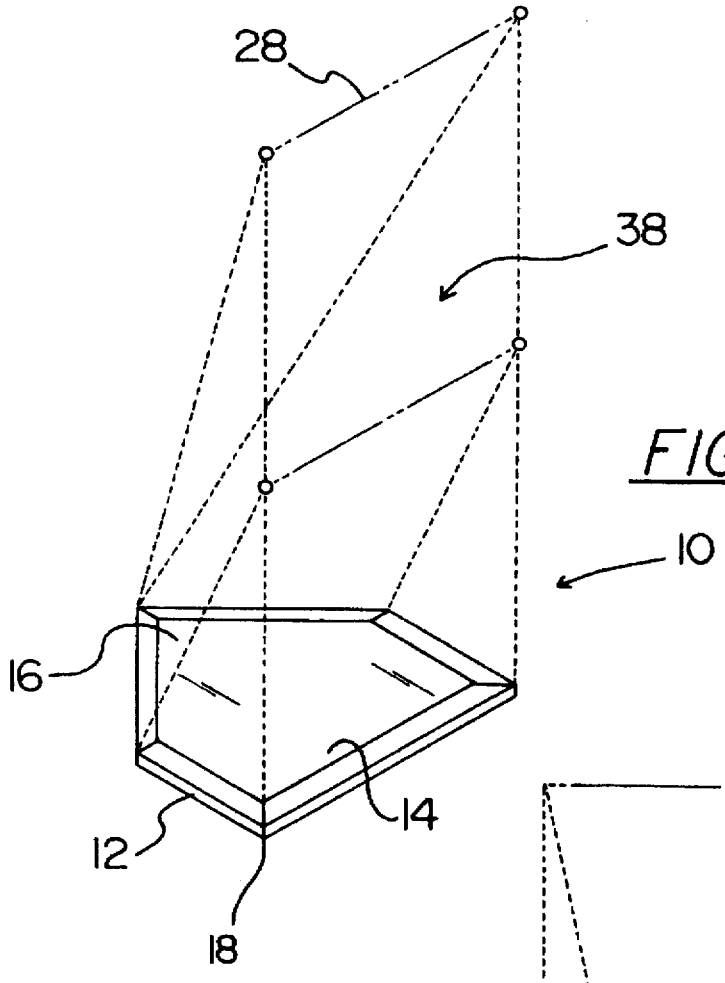
FIG. 1 is a perspective view of the preferred embodiment of the laser beam strike zone indicator constructed in accordance with the principles of the present invention.
Figure 2:
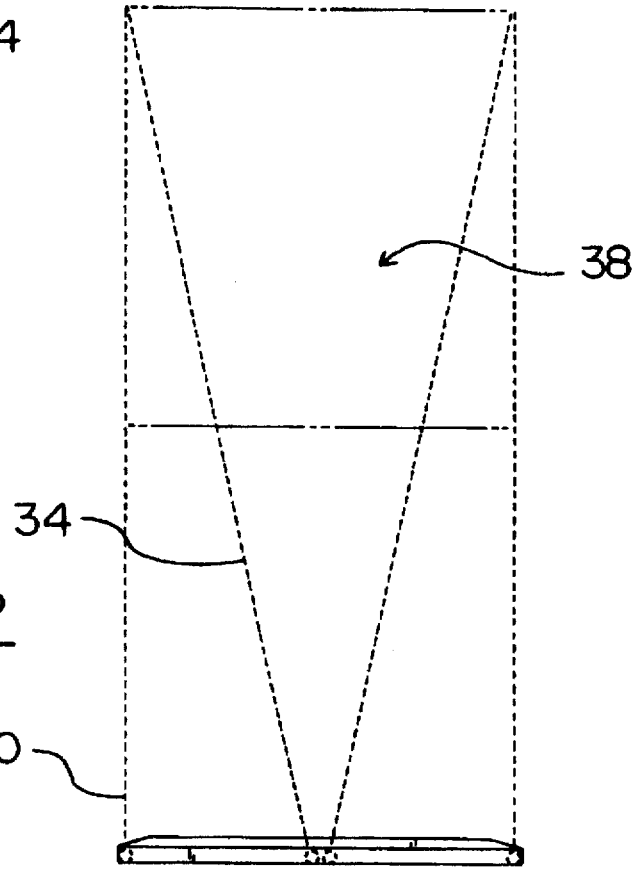
FIG. 2 is a front elevation view of the present invention.
Figure 3:
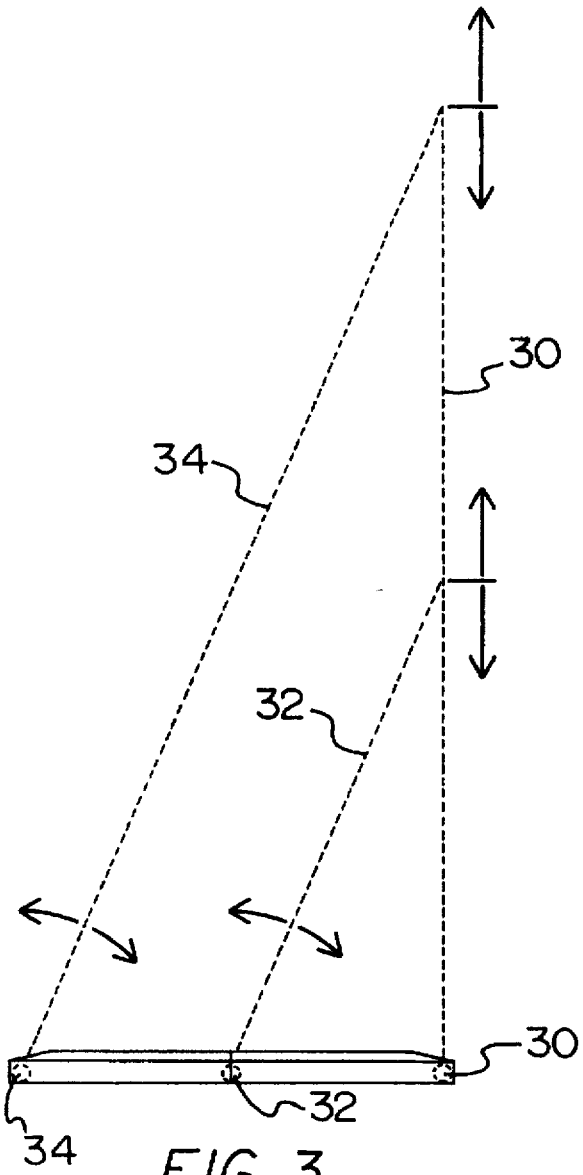
FIG. 3 is a side elevation view of the present invention illustrating the adjustability of the laser beams.
Figure 4:
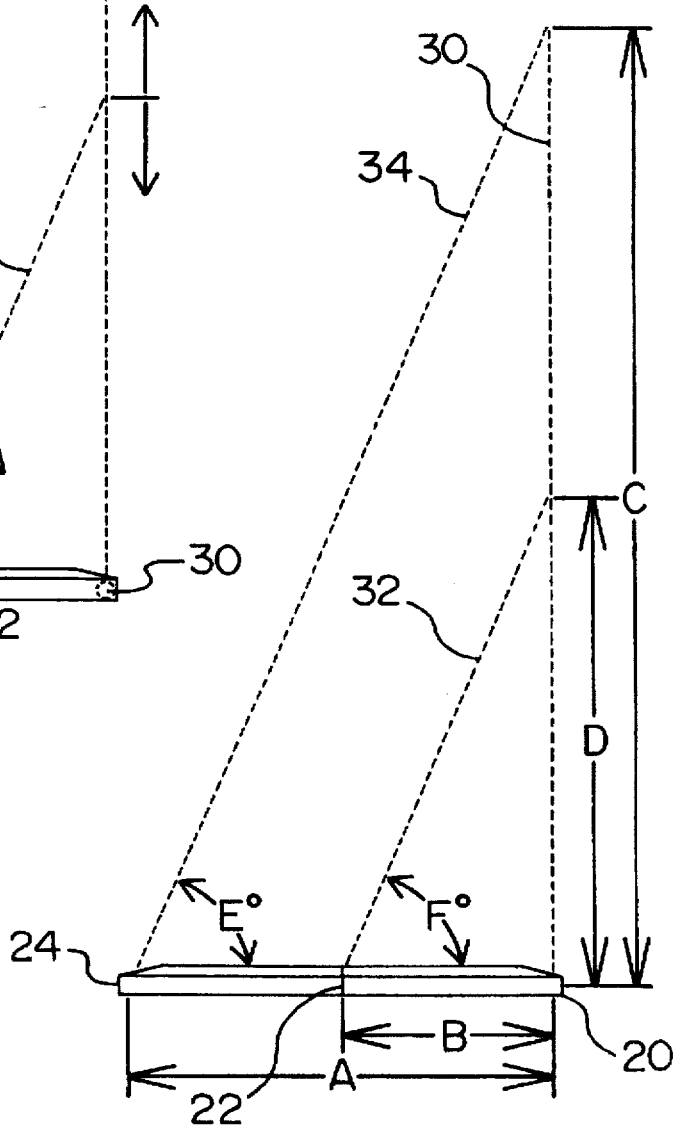
FIG. 4 is a side elevation view of the present invention further illustrating the adjustability of the laser beams.

With reference now to the drawings, and in particular, to FIGS. 1 through 4 thereof, the preferred embodiment of the new and improved laser beam strike zone indicator embodying the principles and concepts of the present invention and generally designated by the reference number 10 will be described.

Specifically, it will be noted in the various Figures that the device relates to a laser beam strike zone indicator for establishing an electronic strike detection zone for baseball and softball. In its broadest context, the device consists of a home plate and a plurality of adjustable laser beams. Such components are individually configured and correlated with respect to each other so as to attain the desired objective.

The device 10 includes a home plate 12 having a front portion 14 and a back portion 16. The front portion 14 has a square configuration and the back portion 16 has a triangular configuration. A base of the back portion 16 is integral with a rear edge of the front portion 14. The home plate 12 is further defined by five corner points 18. The five corner points 18 include two front points 20, two intermediate points 22 and a single rear point 24. The home plate 12 is of a standard configuration and fabrication as that of a standard baseball or softball home plate.

The device 10 includes a plurality of adjustable laser beams 28 comprised of two front beams 30, two intermediate beams 32 and two rear beams 34. The laser beams 28 are created by sensors embedded into the home plate 12. The two front beams 30 are disposed within the two front points 20 of the home plate 12. The two intermediate beams 32 are disposed within the intermediate points 22 of the home plate 12. The two rear beams 34 are disposed within the single rear point 24 of the home plate 12. The two front beams 30 are directed upwardly to a height of a batter's armpits in an orthogonal relationship with respect to opposing sides of the home plate 12. The two intermediate beams 32 are directed angularly upwardly to intersect the two front beams 30 at a height of the batter's knees. The two rear beams 32 are directed angularly upwardly to intersect the two front beams 28 at the height of the batter's armpits. The intersecting beams 28 form a laser-generated strike zone 38 at the front of the home plate 12.

In use, the laser beams 28 are adjusted to suit each individual player. The pitcher throws a ball directed towards the home plate with the desired objective of throwing a strike. If the thrown ball contacts any part of the laser-generated strike zone, a signal will indicate a strike. If the ball does not contact any part of the laser-generated strike zone, no signal is generated thereby indicating a ball.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A laser beam strike zone indicator for establishing an electronic strike detection zone for baseball and softball comprising, in combination:

a home plate having a front portion and a back portion, the front portion having a square configuration and the back portion having a triangular configuration, a base of the back portion integral with a rear edge of the front portion, the home plate further being defined by five corner points, the five corner points including two front points, two intermediate points and a single rear point; and a plurality of adjustable laser beams comprising two front beams, two intermediate beams and two rear beams, the two front beams disposed within the two front points of the home plate, the two intermediate beams disposed within the intermediate points of the home plate, the two rear beams disposed within the single rear point of the home plate, the two front beams directed upwardly to a height of a batter's armpits in an orthogonal relationship with respect to opposing sides of the home plate, the two intermediate beams directed angularly upwardly to intersect the two front beams at a height of the batter's knees, the two rear beams directed angularly upwardly to intersect the two front beams at the height of the batter's armpits.

2. A laser beam strike zone indicator for establishing an electronic strike detection zone for baseball and softball comprising:

a home plate, the home plate further being defined by five corner points, the five corner points including two front points, two intermediate points and a single rear point, a plurality of adjustable laser beams directed upwardly from the five corner points of the home plate to define a strike zone for a height of a predetermined batter, the plurality of adjustable laser beams comprising two front beams, two intermediate beams and two rear beams, the two front beams disposed within the two front points of the home plate, the two intermediate beams disposed within the intermediate points of the home plate, the two rear beams disposed within the single rear point of the home plate.

3. The strike indicator as set forth in claim 2 wherein the two front beams directed upwardly to a height of a batter's armpits in an orthogonal relationship with respect to opposing sides of the home plate, the two intermediate beams directed angularly upwardly to intersect the two front beams at a height of the batter's knees, the two rear beams directed angularly upwardly to intersect the two front beams at the height of the batter's armpits.

* * * * *